US007100698B2

(12) United States Patent
Kracik et al.

(10) Patent No.: US 7,100,698 B2
(45) Date of Patent: Sep. 5, 2006

(54) MAKE-UP CONTROL SYSTEM FOR TUBULARS

(75) Inventors: John Kracik, Orange, CA (US); Hans van Rijzingen, Oosterhout (NL)

(73) Assignee: Varco I/P, Inc., Orange, CA (US)

( * ) Notice: Subject to any disclaimer, the term of this patent is extended or adjusted under 35 U.S.C. 154(b) by 152 days.

(21) Appl. No.: 10/682,632

(22) Filed: Oct. 9, 2003

(65) Prior Publication Data

US 2005/0077084 A1 Apr. 14, 2005

(51) Int. Cl.
*E21B 19/16* (2006.01)

(52) U.S. Cl. ..... 166/380; 166/250.01; 166/77.51; 173/164

(58) Field of Classification Search ..... 166/380, 166/77.51, 250.01; 173/164, 165, 217, 5, 173/6

See application file for complete search history.

(56) References Cited

U.S. PATENT DOCUMENTS

| | | | | |
|---|---|---|---|---|
| 3,800,277 | A | 3/1974 | Patton et al. | |
| 4,365,402 | A * | 12/1982 | McCombs et al. | 29/407.03 |
| 4,402,052 | A * | 8/1983 | Stone et al. | 700/159 |
| 4,592,125 | A * | 6/1986 | Skene | 29/407.03 |
| 4,605,077 | A | 8/1986 | Boyadjieff | |
| 4,625,796 | A | 12/1986 | Boyadjieff | |
| 4,765,401 | A | 8/1988 | Boyadjieff | |
| 4,809,792 | A | 3/1989 | Lynch | |
| 4,813,498 | A | 3/1989 | Lynch et al. | |
| 4,821,814 | A | 4/1989 | Willis et al. | |
| 4,832,552 | A | 5/1989 | Skelly | |
| 4,867,236 | A | 9/1989 | Haney et al. | |
| 4,875,530 | A | 10/1989 | Frink et al. | |
| 4,885,963 | A | 12/1989 | Nishikawa | |
| 5,105,519 | A * | 4/1992 | Doniwa | 29/407.02 |
| 5,107,940 | A | 4/1992 | Berry | |
| 5,321,506 | A * | 6/1994 | Sargent | 348/95 |
| 5,637,968 | A * | 6/1997 | Kainec et al. | 318/432 |
| 5,837,907 | A * | 11/1998 | Ohmi et al. | 73/862.23 |
| 6,435,286 | B1 | 8/2002 | Stump et al. | |
| 6,516,896 | B1 * | 2/2003 | Bookshar et al. | 173/1 |
| 6,742,596 | B1 * | 6/2004 | Haugen | 166/380 |
| 6,997,271 | B1 * | 2/2006 | Nichols et al. | 175/56 |
| 2003/0075023 | A1 | 4/2003 | Robichaux | |

(Continued)

OTHER PUBLICATIONS

International Search Report for International Patent Application No. PCT/US03/31830; 3pp.

*Primary Examiner*—David Bagnell
*Assistant Examiner*—Shane Bomar
(74) *Attorney, Agent, or Firm*—Christie, Parker & Hale, LLP

(57) ABSTRACT

A make-up control method and system for creating a threaded connection between a first tubular and a second tubular are provided. The make-up control system including a top drive connected to the first tubular and a controller operably connected to the top drive that sends at least one command signal to the top drive. The top drive generating a torque and a rotational speed in response to the at least one command signal that are applied to the first tubular during a make-up process between the first and second tubulars. The top drive also generating a torque feedback signal that is transmitted to the controller. The controller using the feedback signals to monitor the torque and rotational speed that are applied to the first tubular during the make-up process. The controller halting the make-up process when a predetermined torque limit is reached.

21 Claims, 10 Drawing Sheets

U.S. PATENT DOCUMENTS

2003/0173073 A1* 9/2003 Snider et al. ..... 166/78.1
2004/0069500 A1 4/2004 Haugen
2004/0144547 A1* 7/2004 Koithan et al. ..... 166/380

* cited by examiner

MAKE-UP CONTROL SYSTEM FOR TUBULARS

FIELD OF THE INVENTION

The present invention relates generally to the field of oil and gas well drilling systems, and more specifically to a control system for making-up threaded connections between threaded tubulars, such as drill casings, using a top-drive.

BACKGROUND OF THE INVENTION

Oil and gas well drilling systems include numerous types of piping, referred to generally as "tubulars." Tubulars include drill pipes, casings, and other threadably connectable oil and gas well structures. Long "strings" of joined tubulars are typically used to drill a wellbore and to prevent collapse of the wellbore after drilling. Some tubulars are fabricated with male threads on one end and female threads on the other. Other tubulars feature a male thread on either end and connections are made between tubulars using a threaded collar with two female threads. The operation of connecting a series of tubulars together to create a "string" is known as a "make-up" process.

One method for making up threaded tubulars involves a multi-step process employing skilled operators using hydraulically actuated tools known as "power tongs". Hydraulic power tongs have several limitations. During some portions of the make-up process, the hydraulic power tong should be able to apply a large amount of torque to a threaded tubular in order to completely make-up the connection. However, in other portions of the make-up process, the hydraulic power tongs should be torque-limited in order to protect the tubulars from damage if they are inadvertently cross-threaded. Furthermore, in some portions of the make-up process, the power tongs should be able to rotate the threaded tubular slowly in order to start the threads of the threaded tubular, and yet be able to quickly rotate the threaded tubular in order to create a connection.

While it may be possible to design practical hydraulic power tongs with some of these features, a design with all of these features may be impractical to implement in the harsh conditions of an oil well drilling rig. In addition, the repetitive processing of the tubulars may lead to fatigue and boredom in the skilled operators, thus resulting in inattention to the make-up process. Accordingly, a need exists for an make-up system that can be automated and has a large dynamic range with respect to both torque and rotational speed.

SUMMARY OF THE INVENTION

The present invention is directed to a make-up control system for creating a threaded connection between a first tubular and a second tubular using a top drive motor. The control system of the current invention monitors, at least one of the number of turns, the torque, and the rotational speed that are applied to the first tubular by a top drive during a make-up process and halts the make-up process if a torque limit is reached. The top drive is an oil and gas well structure that is typically connected to one or more tubulars to provide torque and rotational speed control to the tubulars during the drilling of a wellbore. Top drives are typically not used during make-up processes because of the precise control needed to prevent damage to the treads of the tubulars being connected. As such, the control system of the present invention closely monitors and controls the torque and rotational speed that the top drive applies to the tubulars to protect the threads of the tubulars from damage during the make-up process.

In one embodiment, the present invention is directed to a make-up control system for creating a threaded connection between a first tubular and a second tubular that includes a top drive connected to the first tubular and a controller operably connected to the top drive that sends at least one command signal to the top drive. The top drive generates a torque and a rotational speed in response to the at least one command signal and the desired torque and rotational speed are applied to the first tubular during the make-up process The top drive also generates a torque feedback signal that is transmitted to the controller. The controller uses the feedback signals to monitor the torque and rotational speed that are applied to the first tubular during the make-up process. The controller halts the make-up process when a predetermined torque limit is reached.

In another embodiment, the present invention is directed to a method of using a top drive in a make-up process to create a threaded connection between a first tubular and a second tubular that includes: providing a top drive, connecting the first tubular to the top drive, and operably connecting a controller to the top drive. In such an embodiment, the controller transmits command signals from the controller to the top drive, for example, via a motor drive system. The top drive applies a torque and a rotational speed to the first tubular in response to the command signals. The top drive also transmits a torque feedback signal to the controller. The controller in turn uses the feedback signal to monitor the torque that is applied to the first tubular during the make-up process. A predetermined torque limit is set for at least one of various phases of the make-up process, wherein the controller halts the make-up process when any of the at least one predetermined torque limits are exceeded.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

A shown in FIGS. 1–10, embodiments of the present invention are directed to a make-up control system that may be used to create threaded connections between tubulars during a multi-phased make-up process.

In one embodiment, the make-up control system includes a top drive that is operably connected to a controller for providing number of turns, torque and rotational speed control during the make-up process. In such an embodiment, a rotatable tubular is rotated by the top drive under the control of the controller to create a threaded connection with a stationary tubular.

There are several standard phases to a making-up process. For example, first the make-up control system matches the threads of the tubulars by rotating the rotatable tubular in a direction opposite the threading direction of the threads of the rotatable tubular during a thread matching phase. Once the threads of the tubulars have been matched, the make-up control system rotates the rotatable tubular in a threading direction to initiate the threaded connection of the tubulars during an initial threading phase. After the threading has been initiated, the make-up control system increases the rotational speed of the rotatable tubular during a main threading phase. The make-up control system then decreases the rotational speed of the rotatable tubular near the completion of the threaded connection during a final threading phase so that the tubulars do not experience an abrupt stop. The make-up control system then incrementally increases the torque that is applied to the rotatable tubular until the threaded connection is tightened to a final torque value during a tightening phase.

During each of the above phases of the make-up process, the make-up control system sets either a turn number or a torque limit that the top drive is allowed to apply to the rotatable tubular. The make-up control system then monitors the number of turns, torque and/or the amount of rotation applied to the rotatable tubular by the top drive during each phase of the make-up process and stops the make-up process. When one of the above parameters exceeds the limit for that phase, an error is indicated in the make-up process, such as cross-threading, thread damage, or excessive supply of thread compound, among other possible errors.

Figure 1:
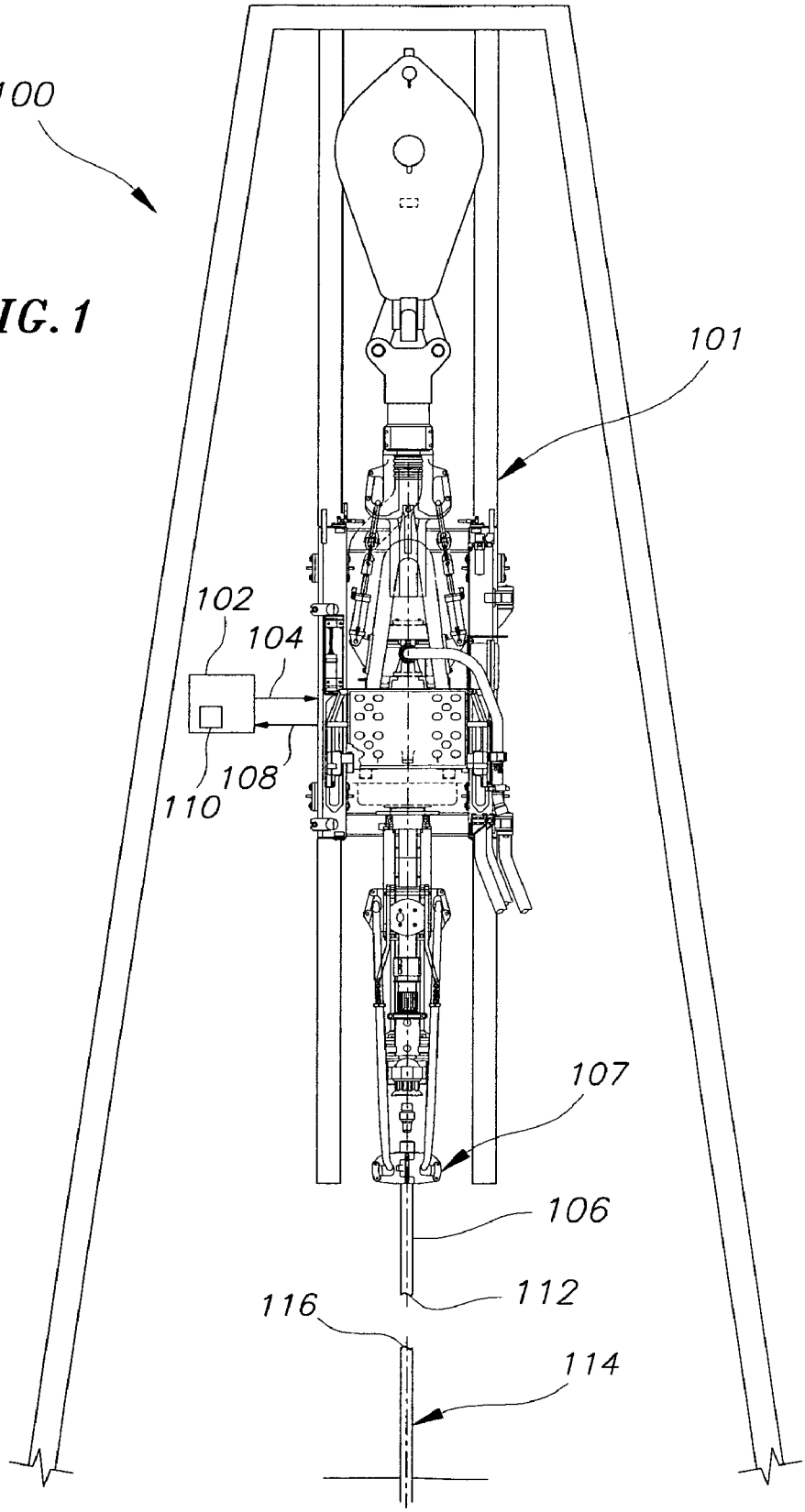
FIG. 1 is a schematic view of a make-up control system in accordance with an exemplary embodiment of the present invention.

FIG. 1 is a schematic view of a make-up control system 100 in accordance with an exemplary embodiment of the present invention. The make-up control system 100 includes a top drive system 101 operably connected to a controller 102. The top drive 101 receives command signals 104 from the controller 102 and responds to the command signals 104 by generating a torque and a rotational speed that are applied to a rotatable tubular 106. In one embodiment, the top drive 101 is connected to a casing running tool 107 that, in turn, is connected to the rotatable tubular 106 to transfer the torque and the rotational speed from the top drive 101 to the rotatable tubular 106.

During operation, the top drive 101 generates feedback signals 108 that are transmitted to the controller 102. The feedback signals 108 include a torque feed back signal and a rotational speed feed back signal. The controller 102 uses feedback signals 108 to monitor the operation of the top drive 101 during the make-up process. The functions of the controller 102 are specified by a set of programming instructions 110 located in the controller 102.

In one embodiment, the rotatable tubular 106 is rotated by the top drive 101 to create a threaded connection with a stationary tubular 114 during a multi-phased make-up process 300 (described in detail below with reference to FIG. 3). In such an embodiment, the rotatable tubular 106 has a threaded portion 112 that mates with a corresponding threaded portion 116 of the stationary tubular 114 to form a threaded connection. Although the above discussion refers to tubulars having mating connections, it should be understood that the tubulars could be casings having male ends connected together through a mating connector having corresponding female ends.

Figure 2:
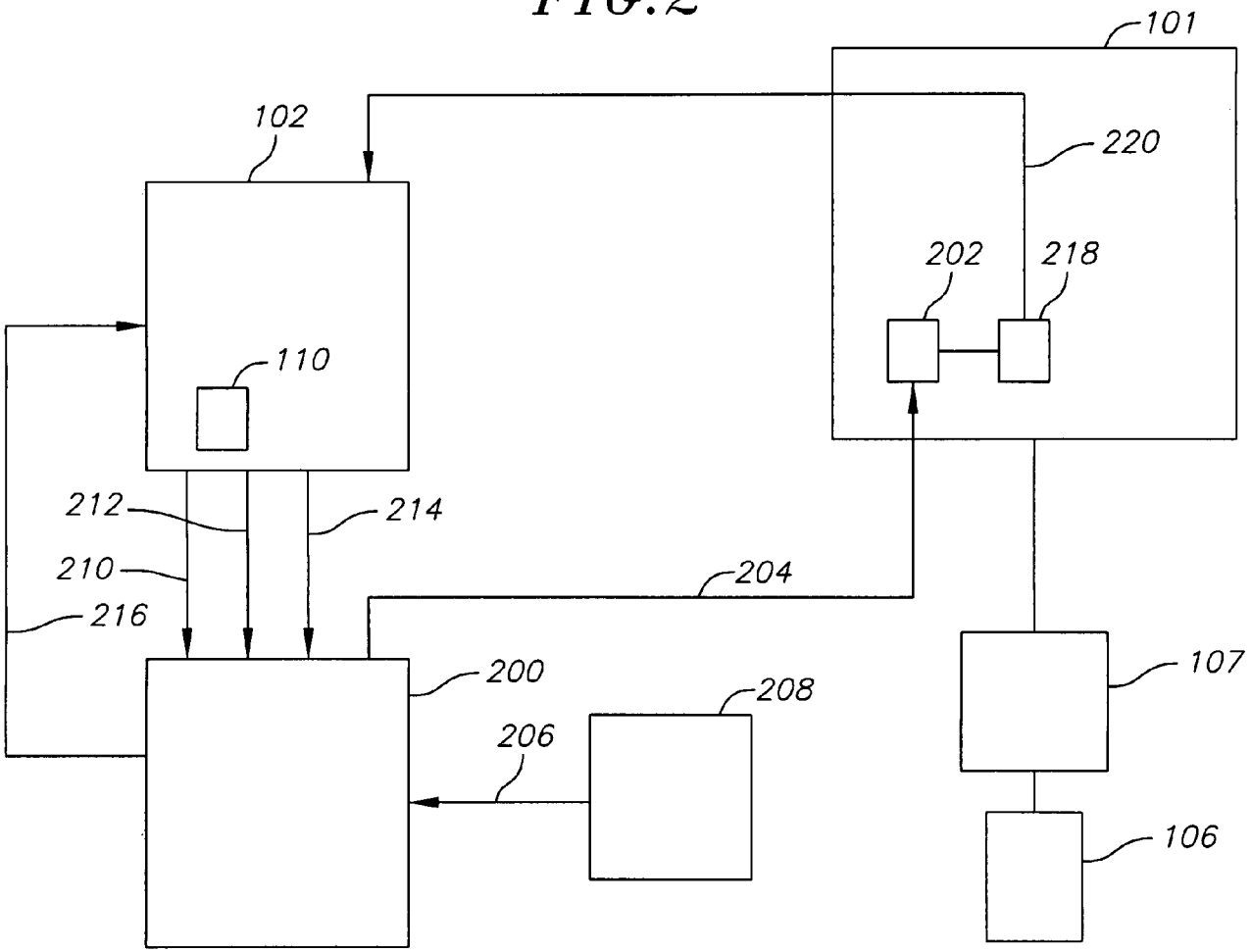
FIG. 2 is a block diagram of a make-up control system in accordance with an exemplary embodiment of the present invention.

FIG. 2 is a block diagram of the make-up control system 100 in accordance with an exemplary embodiment of the present invention. In such an embodiment, the make-up control system 100 includes the top drive 101 and the controller 102 as previously described. In addition, the make-up control system 100 may include a motor controller 200 operatively connected to an electric motor 202. In one such embodiment using a DC motor, the motor controller 200 receives high voltage/high current AC power 206 from an AC power supply 208 and transfers the AC power into regulated and controlled DC power for the electric motor 202. The electric motor 202, in turn, receives the DC power and supplies a torque to the top drive 101 that is transferred to the rotatable tubular 106 during the make-up process 300. The motor controller 200 controls the speed of the electric motor 202 by controlling the voltage applied to the electric motor 202, and regulates the amount of torque that can be applied by the electric motor 202 by regulating the amount of current supplied to the electric motor 202. Although only a DC motor is described above an AC motor could also be used. In such an embodiment the controller would regulate the torque and speed of the AC motor by regulating the frequency of the power supplied to the AC motor.

In one embodiment, the command signals 104 as described above include a directional command signal 210, a torque limit signal 212 and a speed command signal 214. In this embodiment, the motor controller 200 receives the directional command signal 210 transmitted by the make-up system controller 102 and responds to the directional command signal 210 by setting the direction of rotation of the electric motor 202. The electrical motor 202 may also have a directional switch 204 for reversing the direction of rotation of the electrical motor 202. In this way, the make-up system controller 102 of this embodiment may control the rotational direction of the rotatable tubular 106 by generating a directional command signal 210 and transmitting the directional command signal 210 to the motor controller 200.

In such an embodiment, the motor controller 200 may also receive the torque limit signal 212 transmitted by the make-up system controller 102. The motor controller 200 of this embodiment uses the torque limit signal 212 to regulate the maximum amount of current supplied to the electric motor 202. Since the maximum amount of current supplied to the electric motor 202 determines the maximum amount of torque that can be applied by the electric motor 202 to the rotatable tubular 106 the make-up system controller 102 limits the amount of torque that can be applied by the electric motor 202 to the rotatable tubular 106 during the make-up process 300.

The motor controller 200 may also receive the speed command signal 214 transmitted by the make-up system controller 102. The motor controller 200 of such an embodiment uses the speed command signal 214 to regulate the voltage/frequency supplied to the electric motor 202. Since the rotational speed of the electric motor 202 is determined by the voltage/frequency supplied to the electric motor 202, the make-up system controller 102 determines the rotational speed that the electric motor 202 imparts of the rotatable tubular 106 during the make-up process 300. In one embodiment, the motor controller 200 may also include a Silicon Controlled Rectifier (SCR) independently regulating the current and voltage (or frequency) supplied to the electric motor 202.

In one embodiment, the feedback signals 108 as described above include a torque feedback signal 216. In this embodiment, the motor controller 200 generates the torque feedback signal 216 and transmits the signal to the make-up system controller 102. The torque feedback signal 216 is proportional to the electrical current flowing through the electric motor 202 and is thus proportional to the torque applied by the electric motor 202. The make-up system controller 102 uses the torque feedback signal 216 to monitor the amount of torque applied to the rotatable tubular 106 by the electric motor 202 during the make-up process 300.

In one embodiment, the electric motor 202 may also be mechanically coupled to a turn encoder 218. In such an embodiment the turn encoder 218 generates a turn feedback signal 220, which is proportional to the amount of rotation of the electric motor 202. The electric motor 202 is mechanically coupled to the top drive 101, which may be connected to the rotatable tubular 106 through the casing running tool 107 as previously described. Therefore, the amount of rotation of the electric motor 202 is also proportional to the amount of rotation of the rotatable tubular 106. By using the turn feedback signal 220, the make-up system controller 102 can determine the amount of rotation of the rotatable tubular 106 during the make-up process 300.

Figure 3:
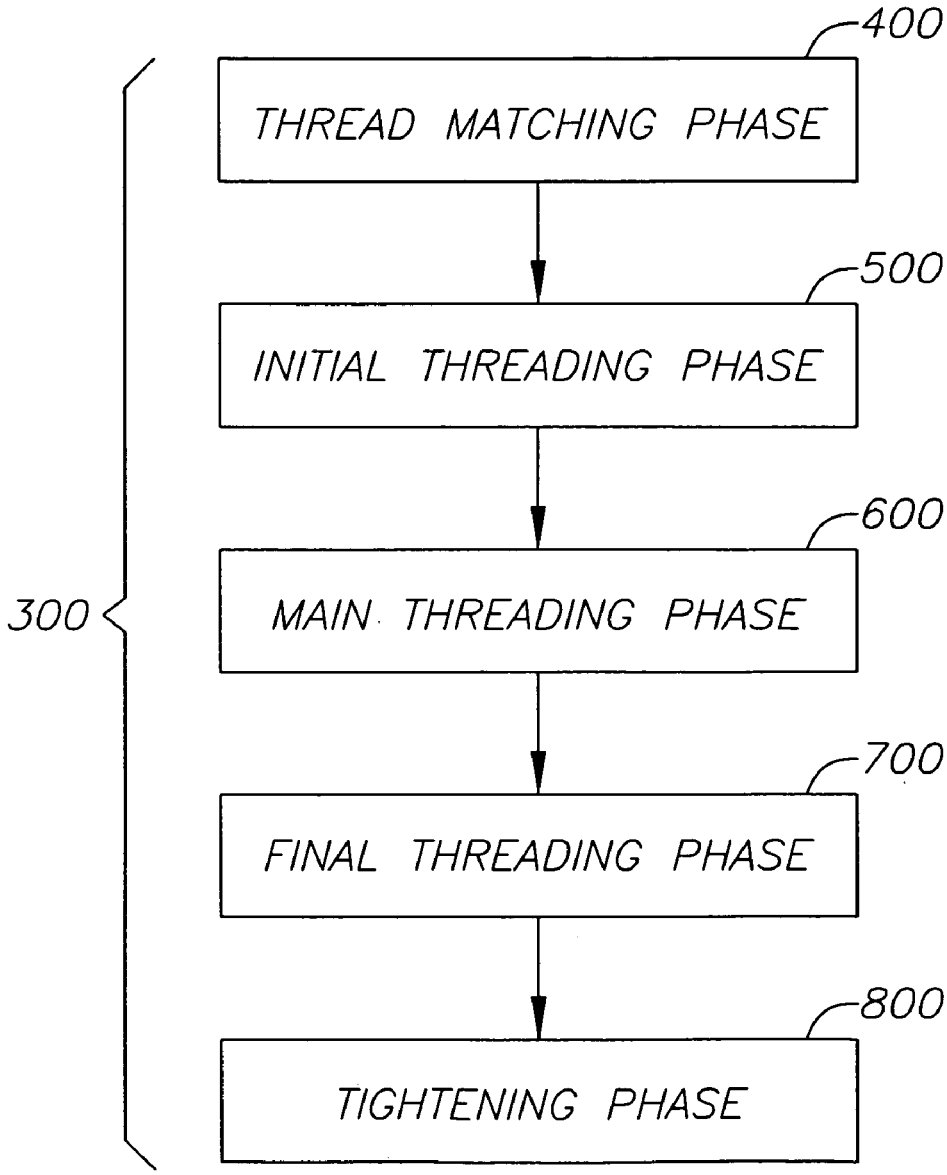
FIG. 3 is a process flow diagram of a make-up process in accordance with an exemplary embodiment of the present invention.

FIG. 3 is a process flow diagram of a make-up process 300 in accordance with an exemplary embodiment of the present invention. The make-up process 300 is implemented by the make-up control system 100 in order to create a threaded connection between the rotatable tubular and the stationary tubular. In one embodiment, as depicted, the make-up process 300 is a multi-phased process that includes a thread matching phase 400, an initial threading phase 500, a main threading phase 600, a final threading phase 700, and a tightening phase 800, each of which will be described in detail below.

Figure 4:
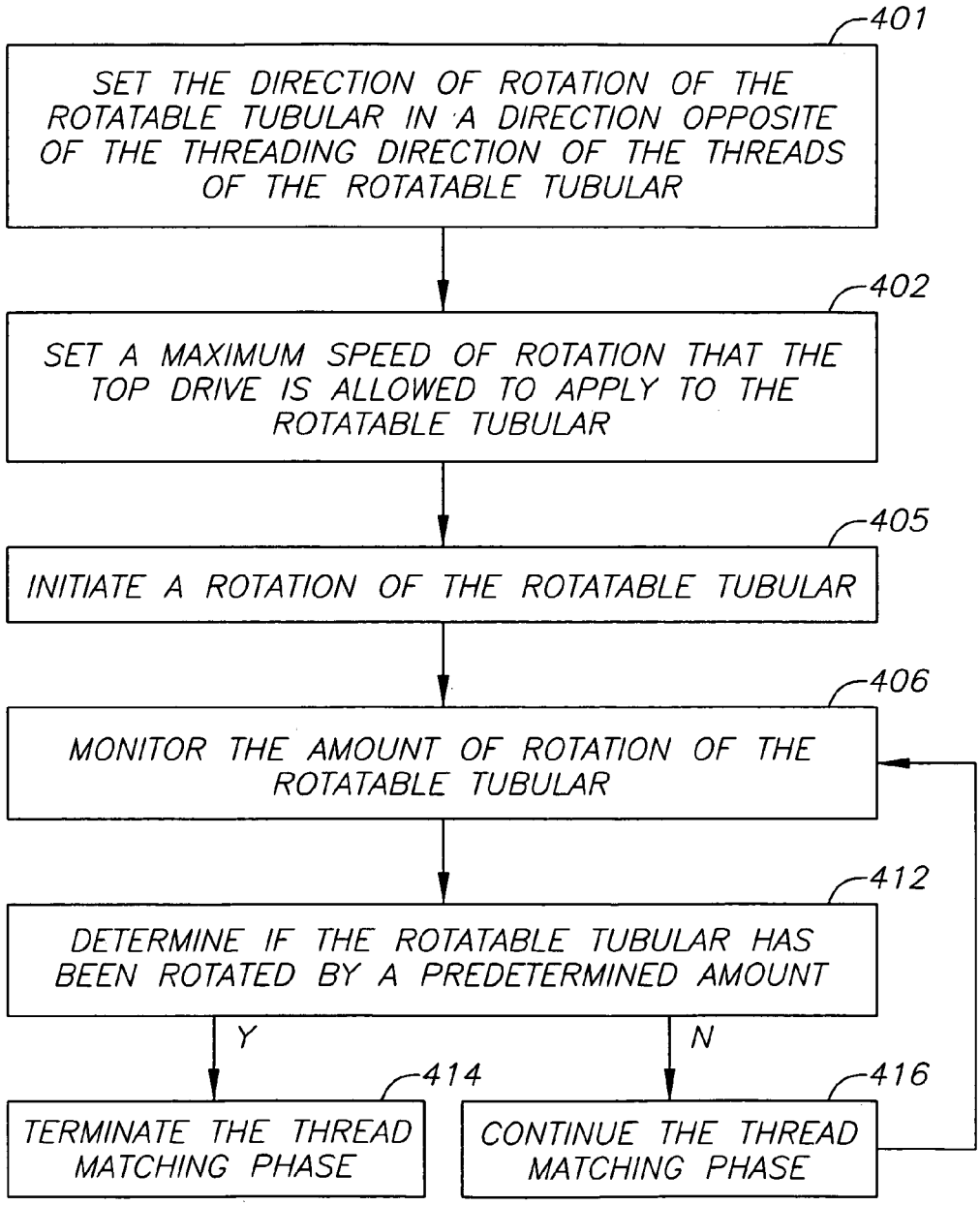
FIG. 4 is a process flow diagram of a thread matching phase of the make-up process according to FIG. 3.

In one embodiment, the make-up process 300 begins with a thread matching phase 400. FIG. 4 is a process flow diagram of the thread matching phase 400 in accordance with an exemplary embodiment of the present invention. During the thread matching phase 400, the make-up control system 100 matches the threads of the rotatable tubular 106 with the threads of the stationary tubular 114.

In the depicted embodiment, the controller 102 sets 401 the direction of rotation of the rotatable tubular 106 in a direction opposite of the threading direction of the threads of the rotatable tubular 106. For example, when the threads of the rotatable tubular 106 are right-hand threads, the rotatable tubular 106 is rotated in a counter-clockwise direction during the thread matching phase 400.

The controller 102 also sets 402 a maximum speed of rotation that the top drive 101 is allowed to apply to the rotatable tubular 106 by generating the speed command signal 214 and transmitting the speed command signal 214 to the motor controller 200 as previously described. For example, in one embodiment the maximum speed of rotation for the rotatable tubular 106 is approximately 8 RPM.

The controller 102 then transmits command signals 104 to the top drive 101, for example through the motor controller 200, to initiate a rotation 405 of the rotatable tubular 106. Throughout the thread matching phase 400, the controller 102 monitors 406 the amount of rotation of the rotatable tubular 106 by monitoring the turn feedback signal 220 transmitted to the controller 102 from the motor controller 220 and the turn encoder 218, respectively, as described above.

The controller 102 determines 412 if the rotatable tubular 106 has been rotated by a predetermined amount. When the rotatable tubular 106 has been rotated by the predetermined amount, the controller 102 terminates 414 the thread matching phase 400. Otherwise, the controller 102 continues 416 the thread matching phase 400 until the rotatable tubular 106 has been rotated by the predetermined amount. In one embodiment, the predetermined amount of rotation of the rotatable tubular 106 during the thread matching phase 400 is one and one half revolutions.

The thread matching phase 400 is completed when the rotatable tubular 106 has been rotated by the predetermined amount. During the thread matching phase 400, the rotatable tubular 106 is preferably rotated at a speed in the range of approximately 5 RPM to approximately 10 RPM at a torque in the range of approximately 500 ft-lbs to approximately 1500 ft-lbs. When the thread matching phase 400 is complete, the make-up control system 100 proceeds to the initial threading phase 500.

Figure 5:
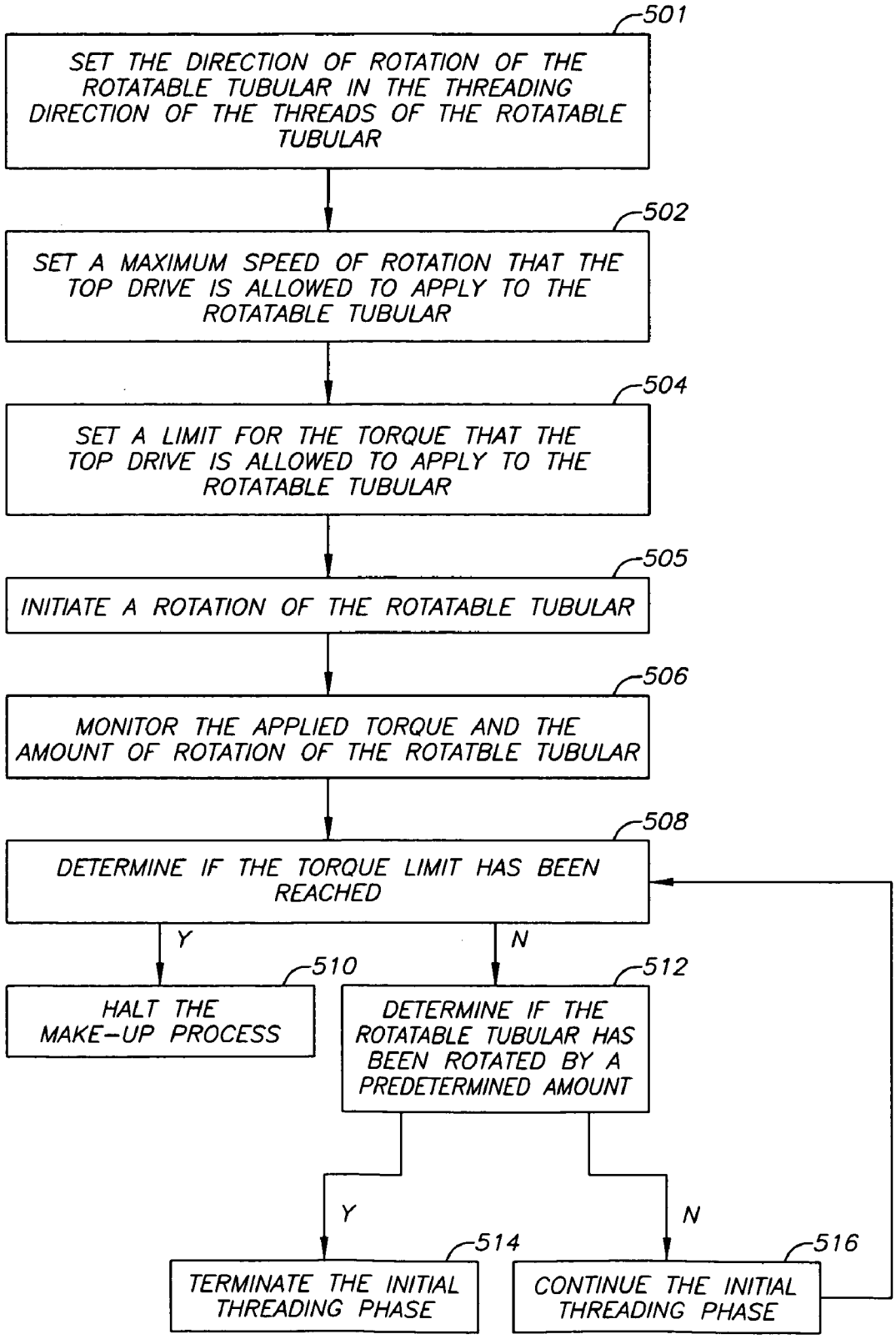
FIG. 5 is a process flow diagram of an initial threading phase of the make-up process according to FIG. 3.

FIG. 5 is a process flow diagram of the initial threading phase 500 in accordance with an exemplary embodiment of the present invention. During the initial threading phase 500, the make-up control system 100 initiates the threaded connection between the rotatable tubular 106 and the stationary tubular 114.

In one embodiment, the controller 102 sets 501 the direction of rotation of the rotatable tubular 106 in the threading direction of the rotatable tubular 106. For example, if the threads of the rotatable tubular 106 are right-hand threads, the rotatable tubular 106 is rotated in a clockwise direction during the initial threading phase 500. The controller 102 also sets 502 the maximum speed of rotation of the rotatable tubular 106 by generating the speed command signal 214 and transmitting the speed command signal 214 to the motor controller 200 as previously described. The make-up control system 100 also sets 504 a limit for the torque that the top drive 101 is allowed to apply to the rotatable tubular 106 by generating the torque limit signal 212 and transmitting the torque limit signal 212 to the motor controller 200 as previously described. For example, in one embodiment the maximum speed of rotation and the torque limit for the rotatable tubular 106 are approximately 8 RPM and approximately 1500 ft-lbs, respectively.

The controller 102 then transmits command signals 104 to the top drive 101 to initiate a rotation 505 of the rotatable tubular 106. Throughout the initial threading phase 500, the controller 102 monitors 506 the applied torque and the amount of rotation of the rotatable tubular 106 by monitoring the torque feedback signal 216 and the turn feedback signal 220 transmitted to the controller 102 from the motor controller 220 and the turn encoder 218, respectively, as described above.

The controller 102 determines 508 if the torque limit has been reached. If the torque limit has been reached, thus indicating an error in the initial threading phase 500 such as a cross-threading of the threads, the controller 102 halts 510 the make-up process 300 and ceases rotation of the rotatable tubular 106.

If the torque limit has not been reached, the controller 102 determines 512 if the rotatable tubular 106 has been rotated by a predetermined amount. When the rotatable tubular 106 has been rotated by the predetermined amount, the controller 102 terminates 514 the initial threading phase 500. Otherwise, the controller 102 continues 516 the initial threading phase 500 until either the torque limit has been reached or the rotatable tubular 106 has been rotated by the predetermined amount. In one embodiment, the predetermined amount of rotation of the rotatable tubular 106 during the initial threading phase 500 is two revolutions.

The initial threading phase 500 is successfully completed when the rotatable tubular 106 has been rotated by the predetermined amount without exceeding the torque limit of the initial threading phase 500. During the initial threading phase 500, the rotatable tubular 106 is preferably rotated at a speed in the range of approximately 5 RPM to approximately 10 RPM at a torque in the range of approximately 1000 ft-lbs to approximately 2000 ft-lbs. When the initial threading phase 500 is complete, the make-up control system 100 proceeds to the main threading phase 600.

Figure 6:
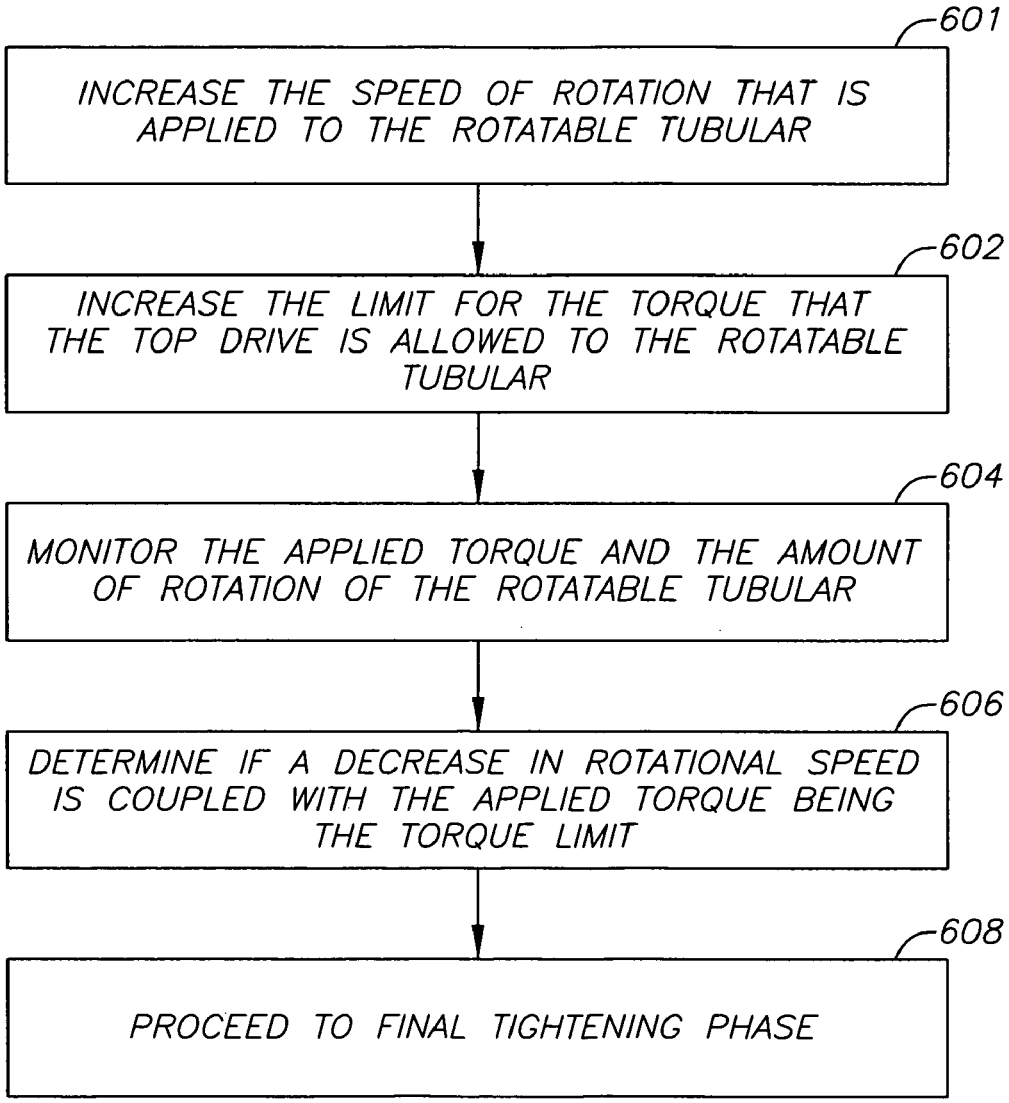
FIG. 6 is a process flow diagram of a main threading phase of the make-up process according to FIG. 3.

FIG. 6 is a process flow diagram of the main threading phase 600 in accordance with an exemplary embodiment of the present invention. During the main threading phase 600, the controller 102 increases 601 the speed of rotation that is applied to the rotatable tubular 106 from the speed of the rotation that was applied to the rotatable tubular 106 during the initial threading phase 500. Increasing the rotational speed that is applied to the rotatable tubular 106 creates an increased resistance in the threads to being rotated and therefore requires a corresponding increase 602 in the limit for the torque that the top drive 101 is allowed to apply to the rotatable tubular 106, i.e. the controller 102 compensates for the increased resistance to connecting the threads at the higher rotational speed by increasing the limit for the torque that the top drive 101 is allowed to apply to the rotatable tubular 106. For example, in one embodiment the torque limit for the rotatable tubular 106 is approximately 7000 ft-lbs.

Throughout the main threading phase 600 the controller continues to monitor 604 the applied torque and the amount of rotation of the rotatable tubular 106 by monitoring the torque feedback signal 216 and the turn feedback signal 220 transmitted to the controller 102 from the motor controller 220 and the turn encoder 218, respectively, as described above.

The main threading phase 600 continues until the controller 102 detects 606 a decrease in rotational speed coupled with the applied torque being near the torque limit. The decrease in rotational speed coupled with the applied torque being near the torque limit is caused by the increased resistance created when the threads of the tubulars near a completely threaded engagement. When this situation occurs, the main threading phase 600 is complete and the controller 102 proceeds 608 to the final threading phase 700.

During the main threading phase 600, the rotatable tubular 106 is preferably rotated at a speed in the range of approximately 10 RPM to approximately 20 RPM at a torque in the range of approximately 15 to 30 percent of a final torque limit (described below). For example, in one embodiment, the final torque limit is 25,000 ft-lbs and the torque limit during the main threading phase 600 is approximately 3750 ft-lbs to approximately 7500 ft-lbs. When the main threading phase 600 is complete, the make-up control system 100 proceeds to the final threading phase 700.

Figure 7:
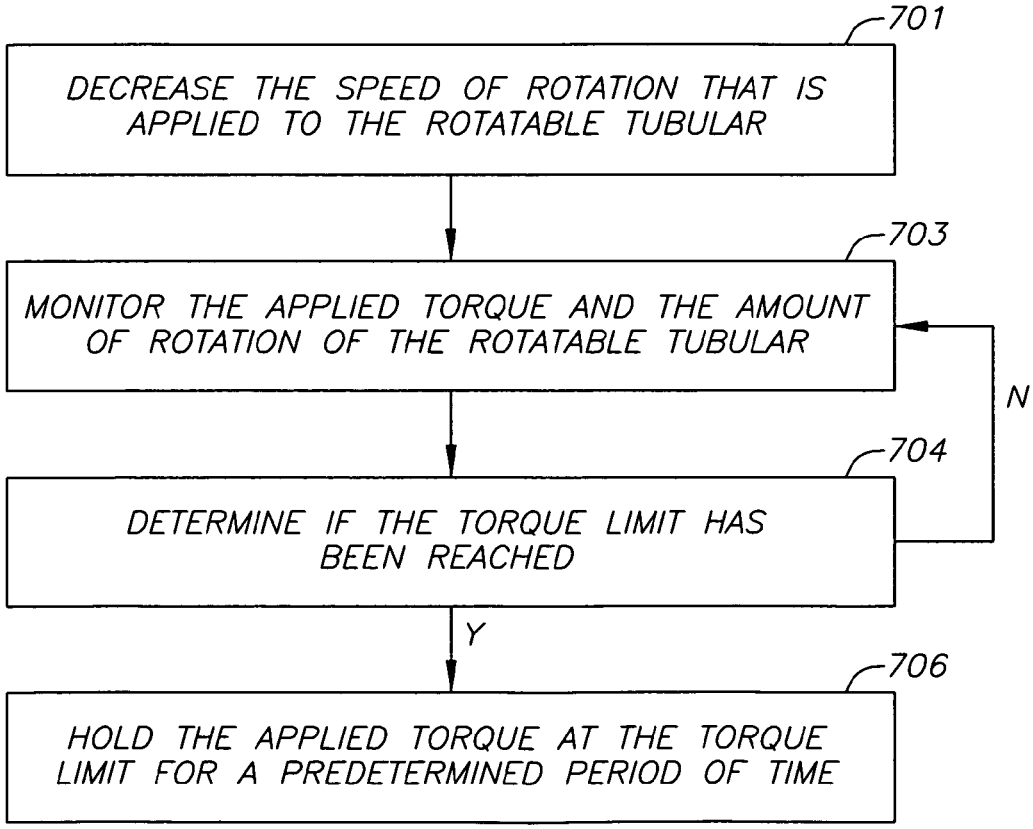
FIG. 7 is a process flow diagram of a final threading phase of the make-up process according to FIG. 3.

FIG. 7 is a process flow diagram of the final threading phase 700 in accordance with an exemplary embodiment of the present invention. During the final threading phase 700, the controller 102 decreases 701 the speed of rotation that is applied to the rotatable tubular 106 from the speed of rotation that was applied to the rotatable tubular 106 during the main threading phase 600. The reduction in speed allows the rotatable tubular 106 to form a threaded connection with the stationary tubular 114 without damaging the tubulars 106 and 114.

For example, in one embodiment the tubulars 106 and 114 each include shoulders adjacent to the threaded portions, 112 and 116 respectively, wherein the shoulders mate with each other when the threaded connection is formed. In this case, turning the rotatable tubular 106 at too high of a rotational speed when the shoulders meet may damage the shoulders and/or the threads of the mated tubulars 106 and 114.

Accordingly, during the final threading phase 700, the rotatable tubular 106 is preferably rotated at a speed in the range of approximately 3 RPM to approximately 8 RPM at a torque in the range of approximately 15 to 30 percent of a final torque limit (described below). For example, in one embodiment, the final torque limit is 25,000 ft-lbs and the torque limit during the final threading phase 700 is approximately 3750 ft-lbs to approximately 7500 ft-lbs. Preferably, the torque limit for the rotatable tubular 106 is approximately 7000 ft.-lbs.

Throughout the final threading phase 700, the controller 102 monitors 703 the applied torque and the amount of rotation of the rotatable tubular 106. When the torque limit is reached, the controller 102 holds 706 the applied torque for a predetermined period of time to verify that a good connection has been made. If the rotatable tubular 106 ceases to rotate at the torque limit, this indicates a good connection between the rotatable tubular 106 and the stationary tubular 114 and the completion of the final threading phase 700. When the final threading phase 700 is complete, the make-up control system 100 proceeds to the tightening phase 800.

Figure 8:
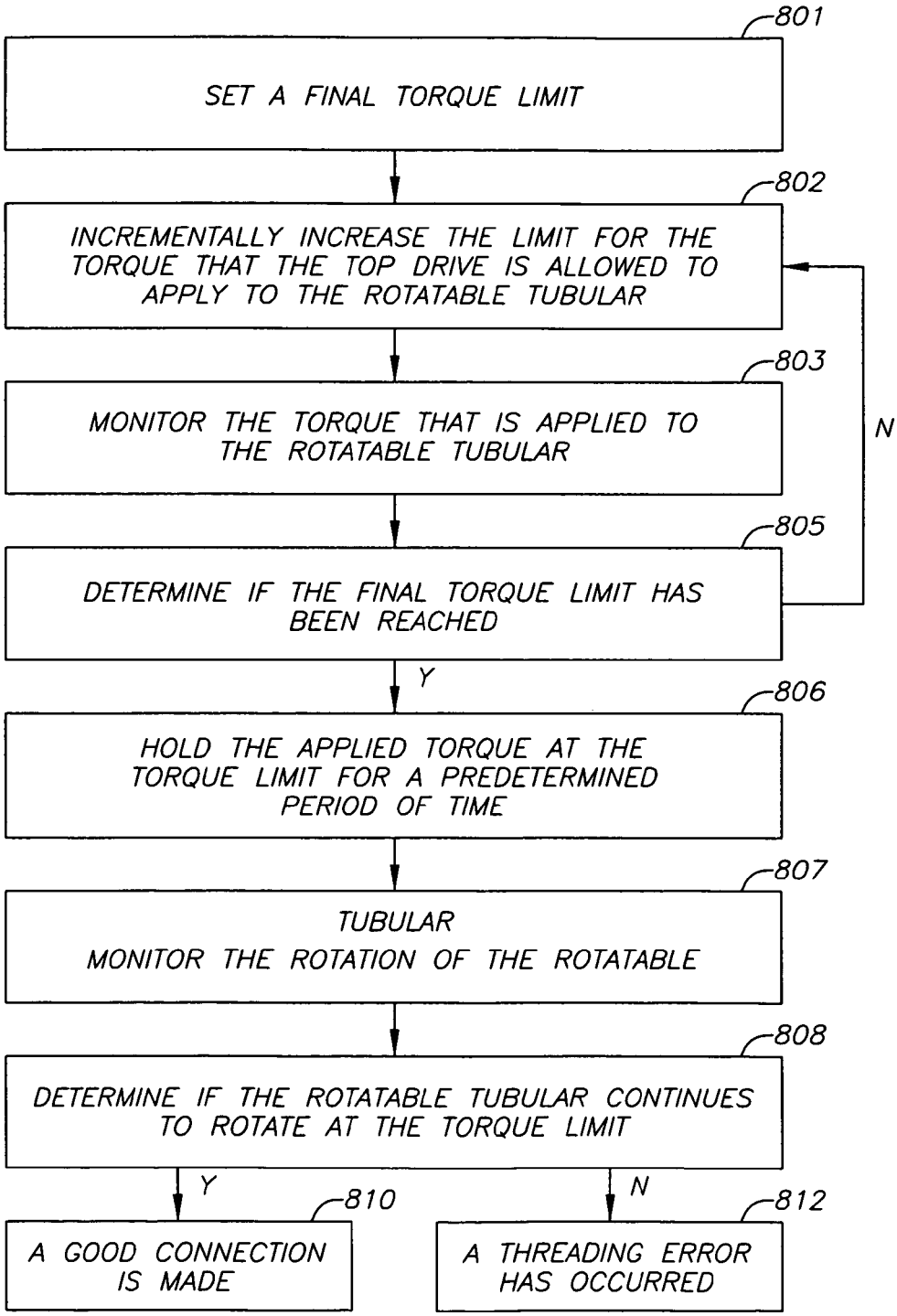
FIG. 8 is a process flow diagram of a tightening phase in accordance with an exemplary embodiment of the present invention.

FIG. 8 is a process flow diagram of the tightening phase 800 in accordance with an exemplary embodiment of the present invention. During the tightening phase 800, the controller 102 sets 801 a final torque limit. The controller then incrementally increases 802 the limit for the torque that the top drive 101 is allowed to apply to the rotatable tubular 106 from the torque limit that was set during the final threading phase 700 to the final torque limit.

Throughout the tightening phase 800, the controller monitors 803 the torque that is applied to the rotatable tubular 106. Rotation continues until the incremental torque limit is reached. When the incremental torque limit is reached, the controller determines 805 if a final torque limit has been reached. If the final torque limit has not been reached, the limit for the torque that the top drive 101 is allowed to apply to the rotatable tubular 106 is again incrementally increased 807 to a new incremental torque limit. This process continues until the final torque limit is reached.

When the final torque limit is reached, the controller 102 holds 806 the applied torque for a predetermined period of time to verify the final connection. The controller 102 then monitors 807 the rotation of the rotatable tubular 106 and determines 808 whether or not rotation continues. If the rotatable tubular 106 continues to rotate 812 at the final torque limit during the predetermined period of time, this indicates a make-up error. If the rotatable tubular 106 ceases to rotate 810 at the torque limit, this indicates a good connection between the rotatable tubular 106 and the stationary tubular 114 and the completion of the tightening phase 800.

During the tightening phase 800, the final torque limit is preferably in the range of approximately 8000 ft-lbs to approximately 35,000 ft-lbs, and each incremental increase in the incremental torque limits is in the range of approximately 50 ft-lbs to approximately 200 ft-lbs. For example, in one embodiment, the final torque limit is approximately 25,000 ft-lbs and each incremental increase in the incremental torque limits is approximately 100 ft-lbs.

Throughout the make-up process 300 as described above, the make-up control system 100 monitors, records, and reports the torque applied to the rotatable tubular 106. In one embodiment, the make-up control system 100 can use this information to create a torque versus turns graph (referred to hereinafter for convenience as a torque-turn graph).

Figure 9:
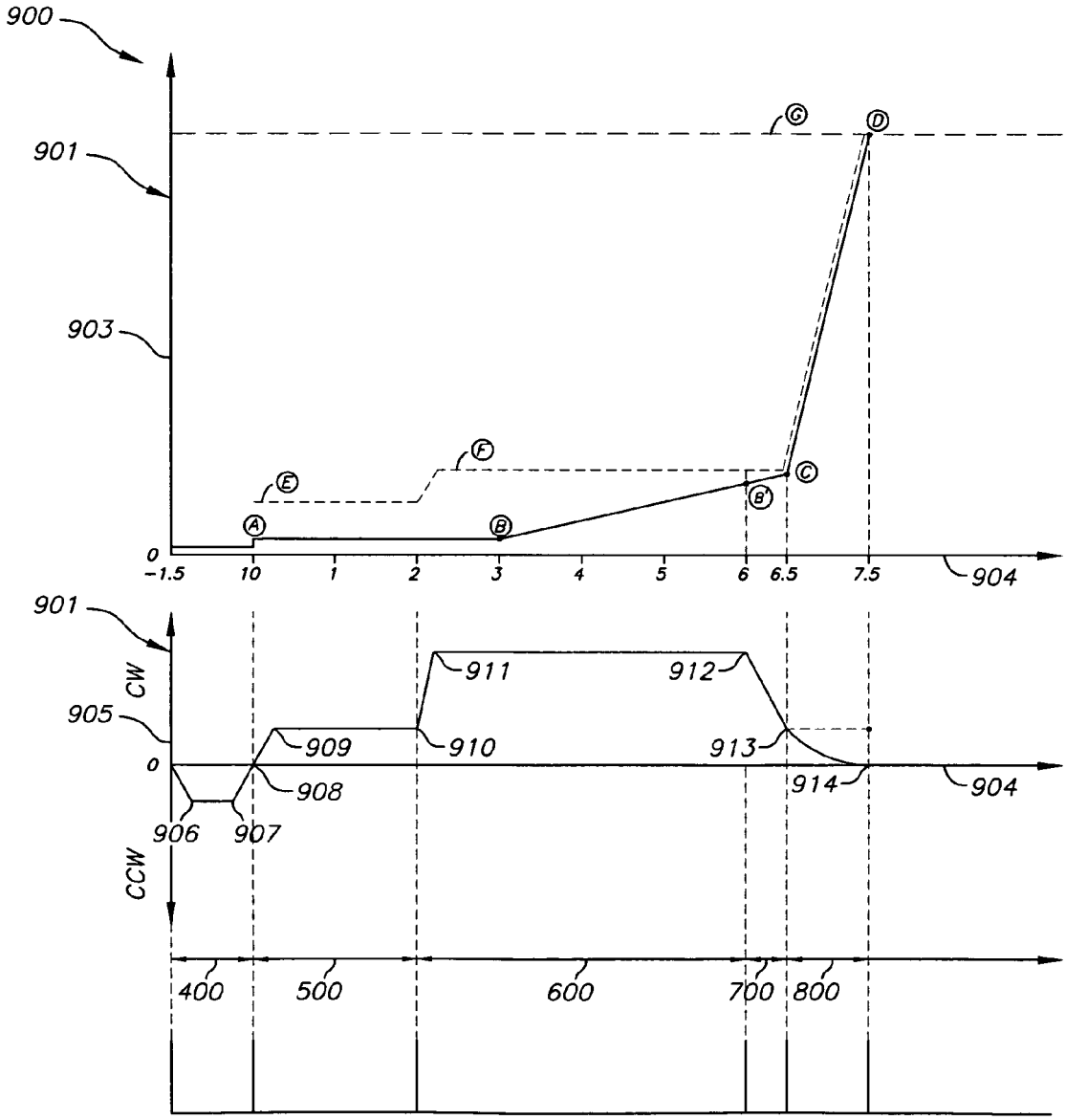
FIG. 9 is a graph illustrating the relationships between torque, rotational direction, and rotations for a make-up control system in accordance with an exemplary embodiment of the present invention.

FIG. 9 is an exemplary torque-turn graph 900 illustrating the relationships between applied torque, torque limits, rotational direction, rotational speed, and rotations or turns for a make-up control system in accordance with an exemplary embodiment of the present invention. The actual number of turns required to make-up a threaded connection, actual torque applied, and torque set limits are dependent upon the type of threaded tubular being connected; therefore, the values shown in the graph 900 are for illustrative purposes only as each of these parameters can be altered either by user inputs into a make-up control system or can be programmatically modified. An upper portion 901 of the graph 900 shows torque 903 vs. turns 904 of a rotated right-handed threaded tubular and a lower portion 902 of the graph 900 shows rotational speed 905 vs. turns 904 of a rotated right-handed threaded tubular.

As previously discussed, during the thread matching phase 400, the threads of the threaded tubular are matched to the threads of a receiving threaded tubular by rotating the threaded tubular in a counter-clockwise direction. As shown in the graph 900, during the thread matching phase 400, the rotational speed increases in a counter-clockwise direction to a point 906 and is held steady to a second point 907 and then brought back to a standstill at a third point three 908. During the thread matching phase 400, the rotated threaded tubular is rotated for one and a half total turns in the counter-clockwise direction.

During the initial threading phase 500, the make-up control system starts the threads of the threaded tubulars. The make-up control system starts rotating the rotated threaded tubular in a clockwise direction until a selected rotational speed is reached at a fourth point 909. The rotational speed is kept constant until two total turns of the rotated threaded tubular are reached at fifth point 910. Also during the initial threading phase 500, a torque limit is set to a first torque limit E by the previously described make-up control system. The actual torque applied to the threaded tubular is then monitored by the make-up control system. If the applied torque exceeds the first torque limit E, the make-up control system will halt the rotation of the rotated threaded tubular.

During the main threading phase 600, the rotational speed is increased until it reaches a maximum at a sixth point 911. Also during the main threading phase 600, the actual torque applied to the threaded tubular will increase as more threads are mated and friction between the mated threads increases as shown from point B to point B'. To compensate for this, the allowable torque limit is increased to a second torque limit F. The main threading phase 600 continues until the controller detects that the rotational speed has decreased coupled with the applied torque being near the second torque limit F. This is shown graphically at a seventh point 912.

During a final threading phase 700 the rotational speed is decreased from the seventh point 912 to an eighth point 913. The rotational speed is decreased during the final threading phase 700 to minimize any damage that might occur when the shoulders of the threads meet at the end of the threading process.

During a tightening phase 800, the connection between the threaded tubulars is tightened to a final torque value G in an incremental process. From point C to point D, the allowable torque limit is slowly increased. At each increase to the torque limit, the previously described electric motor supplying rotational force to the rotated tubular turns the rotated tubular until the applied torque reaches the torque limit at which point the electric motor stalls and ceases turning the rotated threaded tubular. At each increment in the torque limit, the electric motor rotates the rotated threaded tubular for a fraction of a turn and then stalls. This process is repeated until the final torque value G is reached. During the incremental rotations of the rotated threaded tubular the speed is decreased from the eight point 913 to a ninth point 914.

Figure 10:
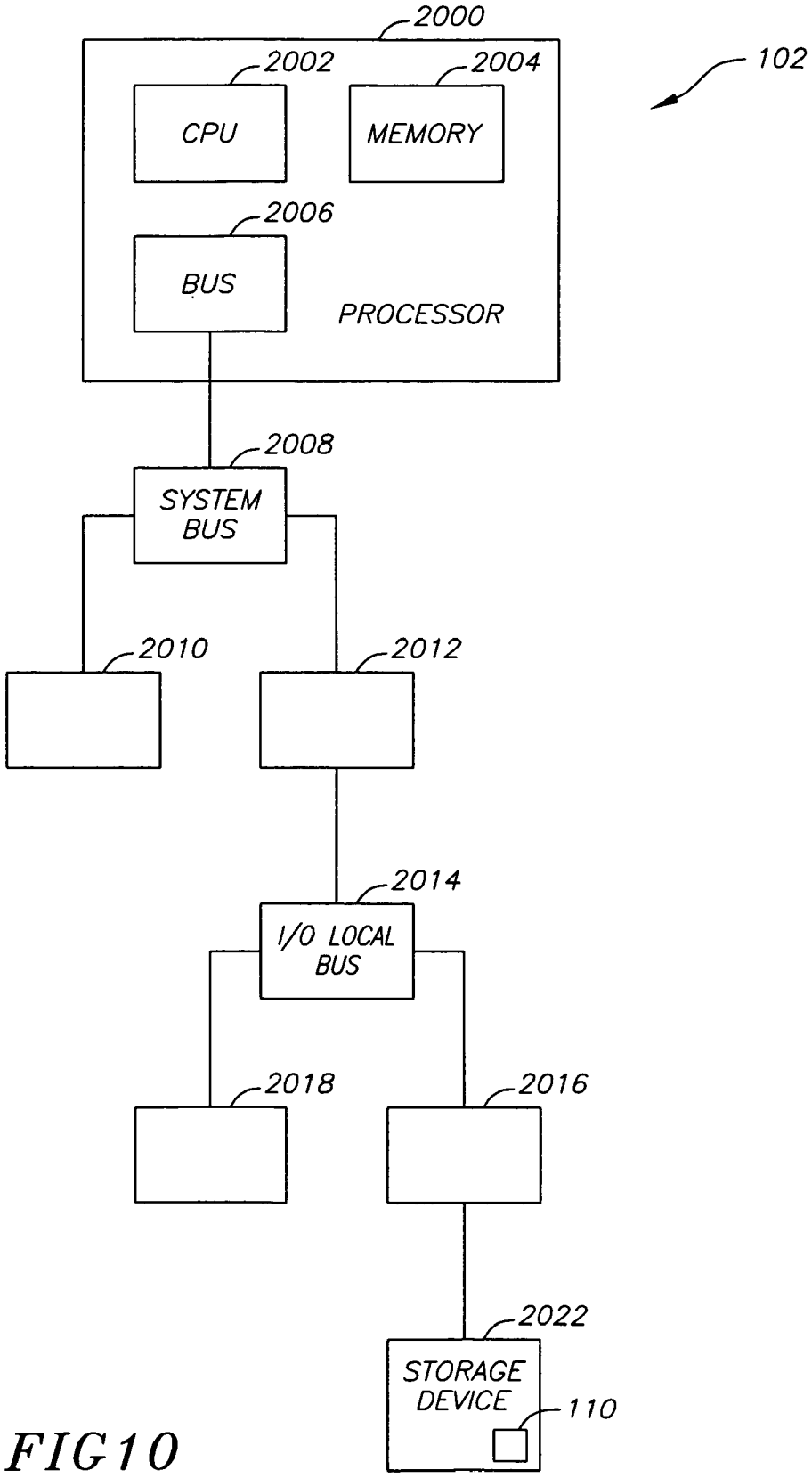
FIG. 10 is a block diagram for a controller in accordance with an exemplary embodiment of the present invention.
Figure 8:
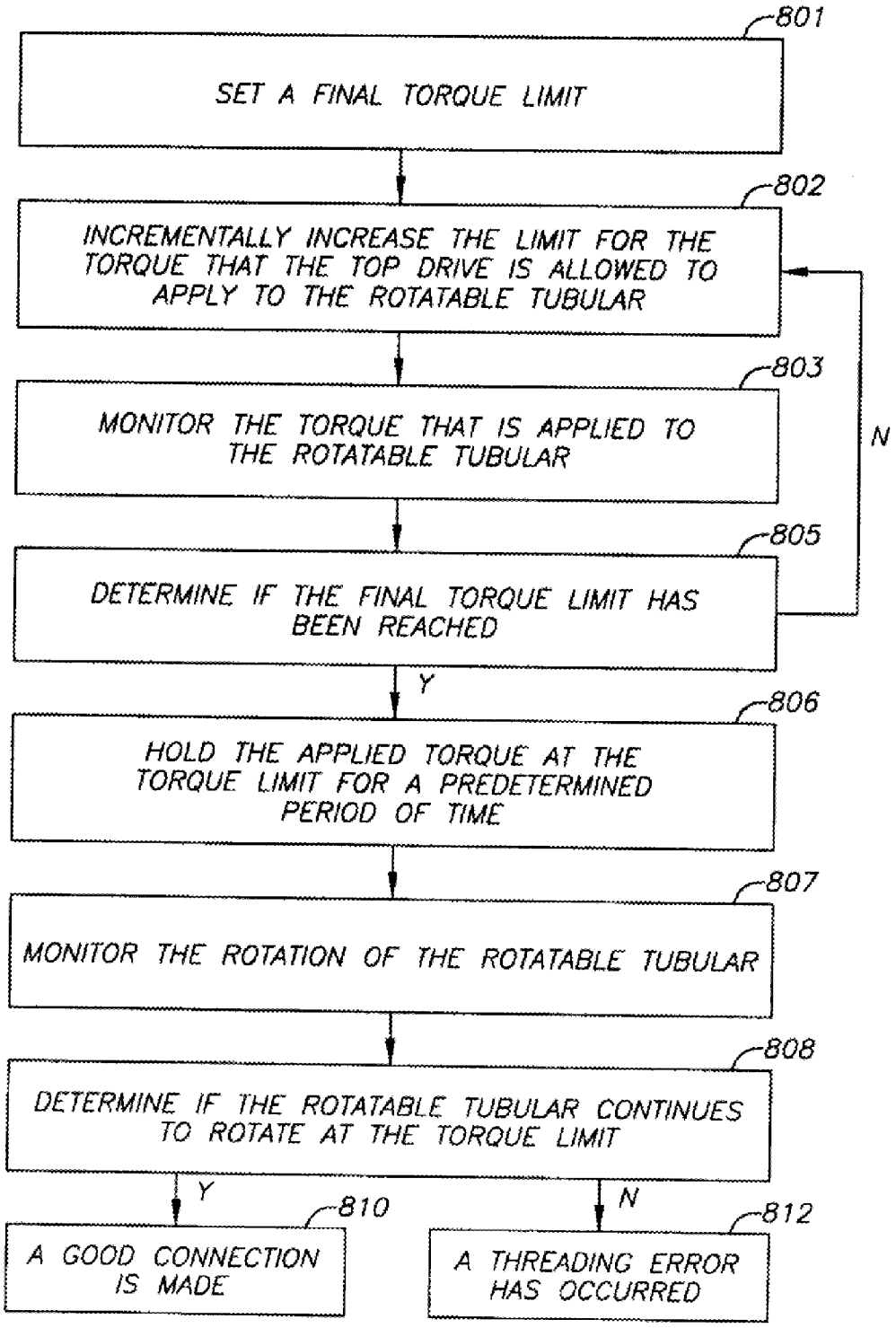
Figure 9:
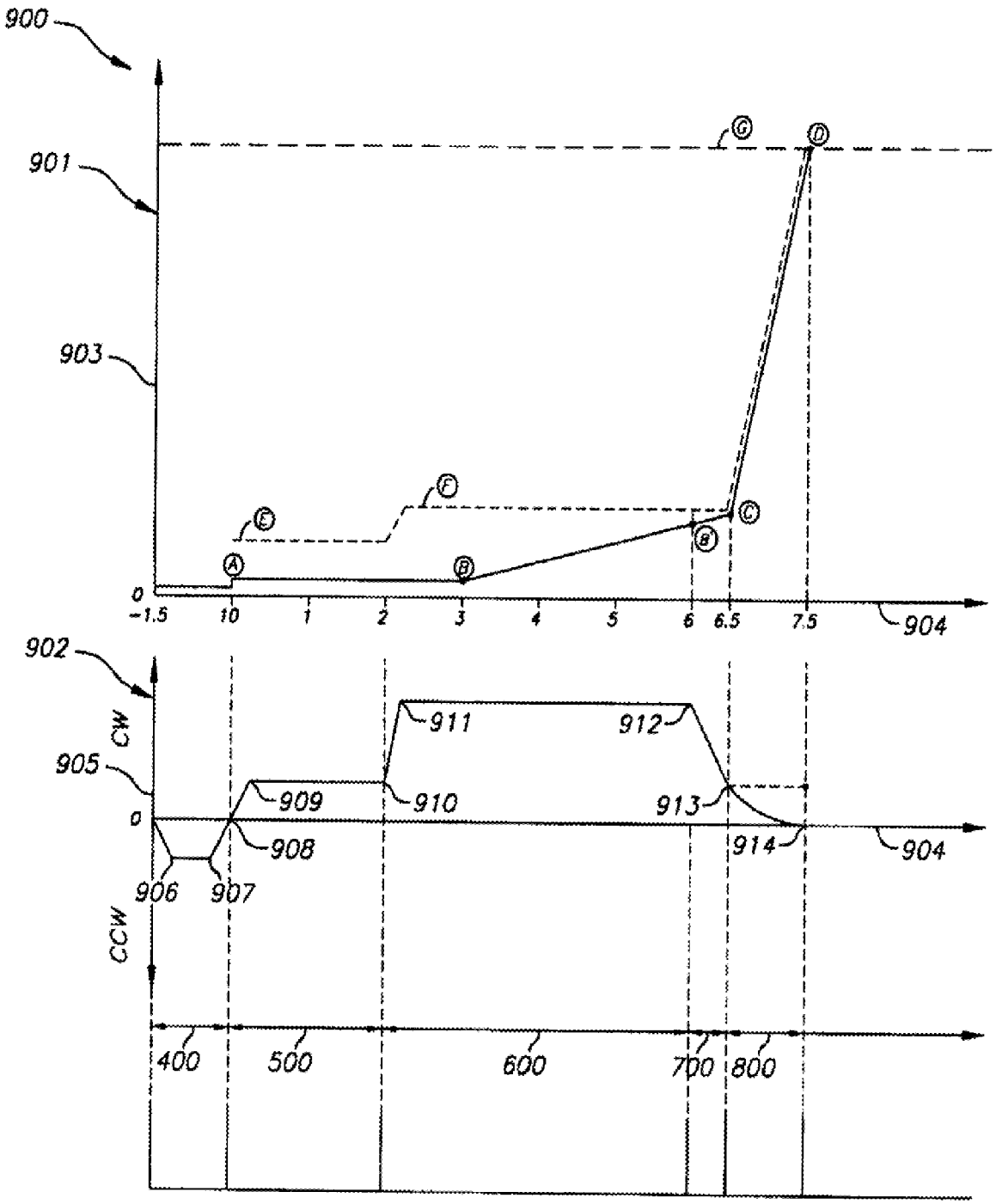

FIG. 10 is a block diagram for the controller 102 in accordance with one embodiment of the present invention. In this embodiment, the controller 102 includes a processor 2000, having a Central Processing Unit (CPU) 2002, a memory cache 2004, and a bus interface 2006. The bus interface 2006 is operatively coupled via a system bus 2008 to a main memory 2010 and an Input/Output (I/O) interface control unit 2012. The I/O interface control unit 2012 is operatively coupled via I/O local bus 2014 to a storage controller 2016, and an I/O interface 2018 for transmission and reception of signals to external devices. The storage controller 2016 is operatively coupled to a storage device 2022 for storage of programming instructions 110 implementing the previously described features of the make-up control system 100.

In operation, the processor 2000 retrieves the programming instructions 110 and stores them in the main memory 2010. The processor 2000 then executes the programming instructions 110 stored in the main memory 2010 to implement the functions of the make-up control system 100 as previously described. The processor 2000 uses the programming instructions 110 to generate the previously described command signals 104 and transmits the command signals 104 via the external I/O device 2018 to the previously described top drive 101. The top drive 101 responds to the command signals 104 and generates the previously described feedback signals 108 that are transmitted back to the controller 102. The processor 2000 receives the feedback signals 108 via the external I/O device 2018. The processor 2000 uses the feedback signals 108 and the programming instructions 110 to generate additional command signals, command signals 210, 212, and 214, for transmission to the top drive 101 as previously described.

The preceding description has been presented with reference to various embodiments of the invention. Persons skilled in the art and technology to which this invention pertains will appreciate that alterations and changes in the described structures and methods of operation can be practiced without meaningfully departing from the principle, spirit and scope of this invention.

For example, although exemplary devices and methods having specific mechanisms and method steps, alternative embodiments could comprise fewer or more steps as required by the specific application. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A make-up control system for creating a threaded connection between a first tubular and a second tubular comprising:

a top drive connected to the first tubular such that the torque and rotational speed of said top drive is transmitted to said first tubular;

a controller operably connected to the top drive to automatically control the direction of rotation, torque and rotational speed being applied to the first tubular via the top drive during a make-up process between the first and second tubulars in accordance with a pre-programmed set of make-up process control instructions, wherein the top drive generates at least torque, turn, and speed feedback signals that are transmitted to the controller, and wherein the controller monitors the feedback signals to determine the torque, number of turns, and speed of rotation that are applied to the first tubular during the make-up process, and wherein the controller continuously controls the direction, torque and speed of rotation of the top drive in response to the feedback signals and in accordance with the pre-programmed set of make-up process control instructions during the make-up process, and halts the make-up process when one of predetermined torque, rotational speed or turn limit is reached.

2. The system of claim 1, wherein the top drive is an electric motor.

3. The system of claim 1, further comprising a motor controller operably connected between the controller and the motor, wherein the motor controller controls the rotational speed that the top drive imparts on the first tubular by controlling an amount of voltage that is applied to the top drive.

4. The system of claim 1, further comprising a motor controller operably connected between the controller and the top drive, wherein the motor controller controls the torque that the top drive imparts on the first tubular by controlling an amount of current that is applied to the top drive.

5. The system of claim 1, further comprising a motor controller that controls a predetermined maximum allowable torque limit that may be applied to the first tubular.

6. The system of claim 1, further comprising a turn encoder that monitors an amount of rotation of the first tubular during the make-up process and generates a turn feedback signal and transmits the turn feedback signal to the controller.

7. A method of using a top drive in a make-up process to create a threaded connection between a first tubular and a second tubular comprising the steps of:

providing a top drive;

connecting the first tubular to the top drive;

operably connecting a controller having a pre-programmed set of make-up process control instructions to the top drive;

transmitting command signals from the controller to the top drive;

generating a rotation direction, a torque and a rotational speed in the top drive, in response to the command signals generated in accordance with the pre-programmed set of make-up process control instructions, and applying the rotation direction, the torque and rotational speed to the first tubular through the top drive during a make-up process between the first and second tubulars;

transmitting at least torque, turn, and rotational speed feedback signals from the top drive to the controller, wherein the controller uses the feedback signals to monitor and control the torque, number of turns, and rotational speed that are applied to the first tubular during the make-up process; and setting predetermined rotation direction, torque, turn, and rotational speed limits for each phase of the make-up process, such that the controller sends a command to the top drive to halt the make-up process or advance to the next phase of the make-up process when any of the predetermined limits are reached.

8. The method of claim 7, wherein the top drive is an electrical motor.

9. The method of claim 7, further comprising the step of providing a motor controller operatively connected between the controller and the top drive.

10. The method of claim 7, further comprising the steps of:

controlling the rotational speed that the top drive imparts on the first tubular by controlling an amount of voltage that is applied to the top drive; and controlling the torque that the top drive imparts on the first tubular by controlling an amount of current that is supplied to the top drive.

11. The method of claim 7, further comprising the step of obtaining torque versus turns data during the make-up process and analyzing the data to determine if the threaded connection between the first and second tubulars is a proper connection.

12. The method of claim 7, further comprising a thread matching phase, which comprises the step of aligning a threaded portion of the first tubular for threading engagement with a threaded portion of the second tubular.

13. The method of claim 12, further comprising an initial threading phase, which comprises the steps of:

setting a predetermined initial threading phase torque limit;

monitoring the amount of rotation of the first tubular; and monitoring the torque applied to the first tubular, wherein the initial threading phase is complete when the first tubular has been rotated by a predetermined amount without exceeding the initial threading phase torque limit.

14. The method of claim 13, further comprising a main threading phase, which comprises the steps of:

increasing the speed of rotation of the first tubular; and increasing the initial threading phase torque limit to a main threading phase torque limit.

15. The method of claim 14, wherein the main threading phase is complete when the controller detects a decrease in the speed of rotation of the first tubular coupled with the torque applied to the first tubular approaching the main threading phase torque limit.

16. The method of claim 15, further comprising a final threading phase, which comprises the steps of:

decreasing the speed of rotation applied to the first tubular below the speed of rotation set during the main threading phase; and increasing the main threading phase torque limit to a final threading phase torque limit.

17. The method of claim 16, wherein the final threading phase is complete when the final threading phase torque limit has been reached.

18. The method of claim 17, further comprising a tightening phase, which comprises the steps of:

setting a final torque limit; and incrementally increasing the final threading phase torque limit until the final torque limit is reached.

19. The method of claim 18, wherein the tightening phase is complete when the torque that is applied to the first tubular reaches the final torque limit and rotating ceases.

20. A method of using a top drive in a make-up process to create a threaded connection between a first tubular and a second tubular comprising the steps of:

providing a top drive;

connecting the first tubular to the top drive;

operably connecting a controller to the top drive;

transmitting command signals from the controller to the top drive;

generating a torque and a rotational speed, in response to the command signals, that are applied to the first tubular by the top drive during a make-up process between the first and second tubulars;

transmitting at least one of either a torque or turn feedback signal from the top drive to the controller, wherein the controller uses the feedback signal to monitor at least one of either the torque or number or turns that are applied to the first tubular during the make-up process;

initiating a thread matching phase, which comprises the step of aligning a threaded portion of the first tubular for threading engagement with a threaded portion of the second tubular;

initiating an initial threading phase, which comprises the steps of:

selling a predetermined initial threading phase torque limit, monitoring the amount of rotation of the first tubular, and monitoring the torque that is applied to the first tubular, wherein the initial threading phase is complete when the first tubular has been rotated by a predetermined amount without exceeding the initial threading phase torque limit;

initiating a main threading phase, which comprises the steps of:

increasing the speed of rotation of the first tubular, and increasing the initial threading phase torque limit to a main threading phase torque limit, wherein the main threading phase is complete when the controller detects a decrease in the speed of rotation of the first tubular that is coupled with the torque that applied to the first tubular being near the main threading phase torque limit;

initiating a final threading phase, which comprises the steps of:

decreasing the increased speed of rotation that is applied to the first tubular, and increasing the main threading phase torque limit to a final threading phase torque limit, wherein the final threading phase is complete when the final threading phase torque limit has been reached; and initiating a tightening phase, which comprises the steps of:

setting a final torque limit, and incrementally increasing the final threading phase torque limit until the final torque limit is reached, wherein the tightening phase is complete when the torque that is applied to the first tubular reaches the final torque limit and rotation ceases, and wherein the threaded connection between the tubulars is complete when the tightening phase is complete.

21. The method of claim 20, further comprising the steps of:

obtaining torque versus turns data during the make-up process; and analyzing the data to determine if the threaded connection is a proper connection.

* * * * *

UNITED STATES PATENT AND TRADEMARK OFFICE

CERTIFICATE OF CORRECTION

PATENT NO. : 7,100,698 B2
APPLICATION NO. : 10/682632
DATED : September 5, 2006
INVENTOR(S) : Kracik et al.

It is certified that error appears in the above-identified patent and that said Letters Patent is hereby corrected as shown below:

On the Title Page

| | |
|---|---|
| (56) References Cited<br>U.S. Patent Documents,<br>6,742,596. . . | Delete “B1”,<br>Insert --B2-- |
| (56) References Cited,<br>U.S. Patent Documents<br>6,997,271. . . | Delete “B1”,<br>Insert --B2-- |

In the Specification

| | |
|---|---|
| Column 1, line 47 | Delete “an make-up”,<br>Insert --a make-up-- |
| Column 1, line 56 | Delete “monitors,”,<br>Insert --monitors-- |
| Column 10, line 17 | Delete “eight”,<br>Insert --eighth-- |
| Column 10, line 60 | Delete “having”,<br>Insert --have-- |

In the Claims

| | |
|---|---|
| Column 13, line 27, Claim 20 | Delete “selling a”,<br>Insert --setting a-- |
| Column 14, line 6, Claim 20 | Delete “that applied”,<br>Insert --that is applied-- |

UNITED STATES PATENT AND TRADEMARK OFFICE

CERTIFICATE OF CORRECTION

PATENT NO. : 7,100,698 B2
APPLICATION NO. : 10/682632
DATED : September 5, 2006
INVENTOR(S) : Kracik et al.

It is certified that error appears in the above-identified patent and that said Letters Patent is hereby corrected as shown below:

In the Drawings

| | |
|---|---|
| FIG. 8, Sheet 8 of 10, Ref. No. 807 | Delete Drawing Sheet 8 and substitute therefore the Drawing Sheet, consisting of Fig. 8, as shown on the attached page |
| FIG. 9, Sheet 9 of 10 | Delete Drawing Sheet 9 and substitute therefore the Drawing Sheet, consisting of Fig. 9, as shown on the attached page |

Signed and Sealed this

Eighth Day of January, 2008

JON W. DUDAS
*Director of the United States Patent and Trademark Office*

UNITED STATES PATENT AND TRADEMARK OFFICE

CERTIFICATE OF CORRECTION

PATENT NO. : 7,100,698 B2
APPLICATION NO. : 10/682632
DATED : September 5, 2006
INVENTOR(S) : Kracik et al.

It is certified that error appears in the above-identified patent and that said Letters Patent is hereby corrected as shown below:

On the Title Page

| | |
|---|---|
| (56) References Cited, U.S. Patent Documents, 6,742,596. . . | Delete “B1”, Insert --B2-- |
| (56) References Cited, U.S. Patent Documents 6,997,271. . . | Delete “B1”, Insert --B2-- |

In the Specification

| | |
|---|---|
| Column 1, line 47 | Delete “an make-up”, Insert --a make-up" |
| Column 1, line 56 | Delete “monitors,”, Insert --monitors-- |
| Column 10, line 17 | Delete “eight”, Insert --eighth-- |
| Column 10, line 60 | Delete “having” Insert --have-- |

In the Claims

| | |
|---|---|
| Column 13, line 27, Claim 20 | Delete “selling a”, Insert --setting a-- |
| Column 14, line 6, Claim 20 | Delete “that applied”, Insert --that is applied-- |

UNITED STATES PATENT AND TRADEMARK OFFICE

CERTIFICATE OF CORRECTION

PATENT NO. : 7,100,698 B2
APPLICATION NO. : 10/682632
DATED : September 5, 2006
INVENTOR(S) : Kracik et al.

It is certified that error appears in the above-identified patent and that said Letters Patent is hereby corrected as shown below:

In the Drawings

| | |
|---|---|
| FIG. 8, Sheet 8 of 10, Ref. No. 807 | Delete Drawing Sheet 8 and substitute therefore the Drawing Sheet, consisting of Fig. 8, as shown on the attached page |
| FIG. 9, Sheet 9 of 10 | Delete Drawing Sheet 9 and substitute therefore the Drawing Sheet, consisting of Fig. 9, as shown on the attached page |

This certificate supersedes the Certificate of Correction issued January 8, 2008.

Signed and Sealed this

Twenty-ninth Day of January, 2008

JON W. DUDAS
*Director of the United States Patent and Trademark Office*